United States Patent [19]

Soby et al.

[11] 4,269,669

[45] May 26, 1981

[54] HIGH SPEED ELECTROPLATING

[75] Inventors: William Soby, Gerrards Cross; Samuel J. B. Johnston, Ashford, both of England

[73] Assignee: EMI Limited, Hayes, England

[21] Appl. No.: 143,118

[22] Filed: Apr. 23, 1980

[30] Foreign Application Priority Data

Jun. 1, 1979 [GB] United Kingdom ..... 19209/79

[51] Int. Cl.[3] ..... C25D 1/10; C25D 21/12

[52] U.S. Cl. ..... 204/5; 204/275

[58] Field of Search ..... 204/5, 273, 275, 276

[56] References Cited

U.S. PATENT DOCUMENTS

| | | | |
|---|---|---|---|
| 1,019,969 | 3/1912 | Lacroix | 204/275 |
| 2,675,348 | 4/1954 | Greenspan | 204/297 |
| 3,186,932 | 6/1965 | Gelfand | 204/5 |
| 3,558,455 | 1/1971 | Sorensen | 204/273 |
| 4,062,755 | 12/1977 | Turner | 204/275 |

FOREIGN PATENT DOCUMENTS

| | | | |
|---|---|---|---|
| 544340 | 7/1957 | Canada | 204/5 |
| 1503553 | 10/1967 | France | 204/5 |
| 1423488 | 2/1976 | United Kingdom | 204/5 |

*Primary Examiner*—T. M. Tufariello

*Attorney, Agent, or Firm*—Fleit & Jacobson

[57] ABSTRACT

An electroplating arrangement, particularly suitable for forming stamper plates for video or audio recordings. The arrangement has a means for inhibiting flow of electrolyte from the region of the anode to the cathode. This means may be a tube which encloses the region between the cathode and anode and has a plurality of inwardly facing holes. Filtered electrolyte is supplied to the tube.

5 Claims, 3 Drawing Figures

HIGH SPEED ELECTROPLATING

Figure 1:
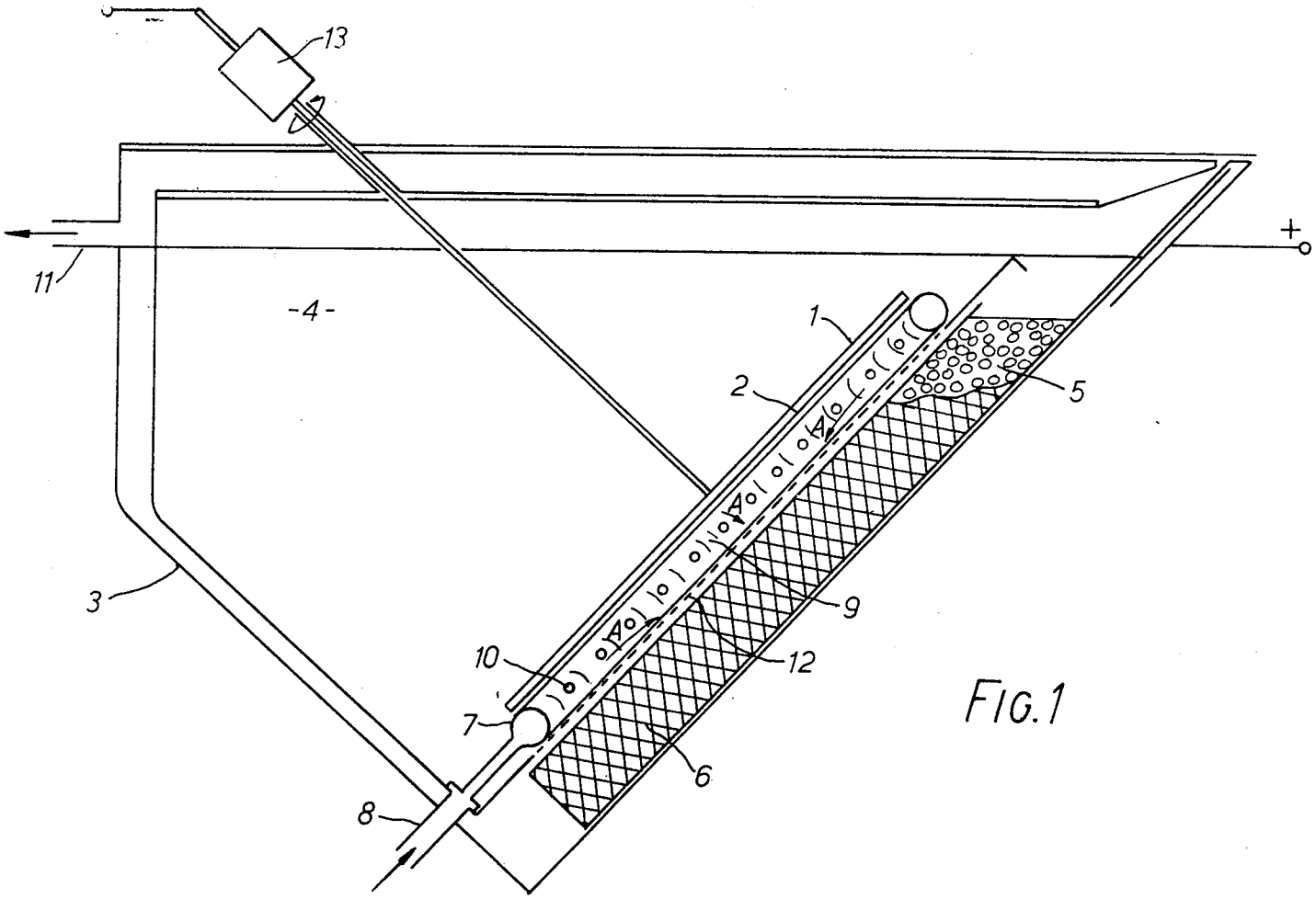

This invention relates to electroplating and especially, although not exclusively, to the formation of stamper plates for moulding disc records.

Stamper plates for disc records are commonly made of nickel and are formed by an electroplating process in which a rotating disc cathode is suspended in a tank of electrolyte opposite a basket, typically of a mesh or cage construction, holding nickel anode material.

Usually, see for example British Pat. No. 1,423,488, the anode material is comprised of loose nickel spheres or cubes, and in order to maintain a constant anode profile opposite the cathode the basket may be inclined to the horizontal. In this position the surface of the basket closest to the cathode defines the profile of the anode surface.

Usually electrolyte is passed through the basket towards the cathode, or alternatively across the surface of the anode, so that in the region between the electrodes the electrolyte is continually replenished.

In operation, it is found with that current densities of up to about 250 A/ft$^2$ some imperfections, in the form of nodules, may develop at the cathode surface, but that above this value the nodules tend to be so large and numerous that a resulting stamper plate is quite unsuitable for moulding disc records. It has been suggested that the nodules are caused by the presence of suspended particles which occur in the electrolyte despite careful filtration. Since the rate of plating is roughly proportional to the current density used, this imposes a limitation on the production rate of the stamper plates.

It is, therefore, an object of the present invention to provide an improved form of electroplating arrangement in which substantially nodule free plates may be formed even at relatively high current densities.

Accordingly the invention provides an electroplating arrangement comprising in a container for an electrolyte, an anode, a cathode having a plating surface, and a means for inhibiting the flow of electrolyte from the region of the anode towards the cathode surface. Preferably this means is arranged to cause a flow substantially towards the anode.

Preferably the flow means comprises a tube which, at least adjacent to the plane of the cathode surface, encloses the region between the cathode and anode, and has a plurality of inwardly facing holes, and a means for supplying filtered electrolyte to the tube. With this arrangement a high pressure region is developed in the electrolyte close to the cathode surface and this prevents electrolyte from flowing from the anode to the cathode, thereby ensuring that particles detached from the anode are not transported to the cathode.

The tube may enclose substantially the whole of the region between the cathode and anode.

The flow means may alternatively be a suction means positioned below the anode.

The anode may comprise anode material contained within an anode basket and both the basket and the cathode surface may be inclined to the horizontal. The angle of inclination of the anode basket and the cathode surface may lie between 30° and 60° and is preferably 45°.

The anode material may be nickel and the electrolyte may comprise a solution of a major proportion of a nickel salt such as nickel sulphamate and a minor proportion of boric acid.

According to another aspect of the invention there is provided a stamper plate whenever formed using an electroplating arrangement, as described above.

Figure 2:
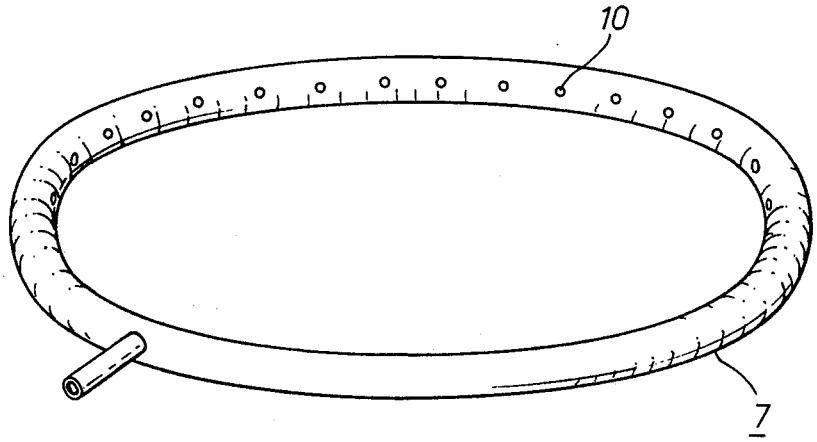
Figure 3:
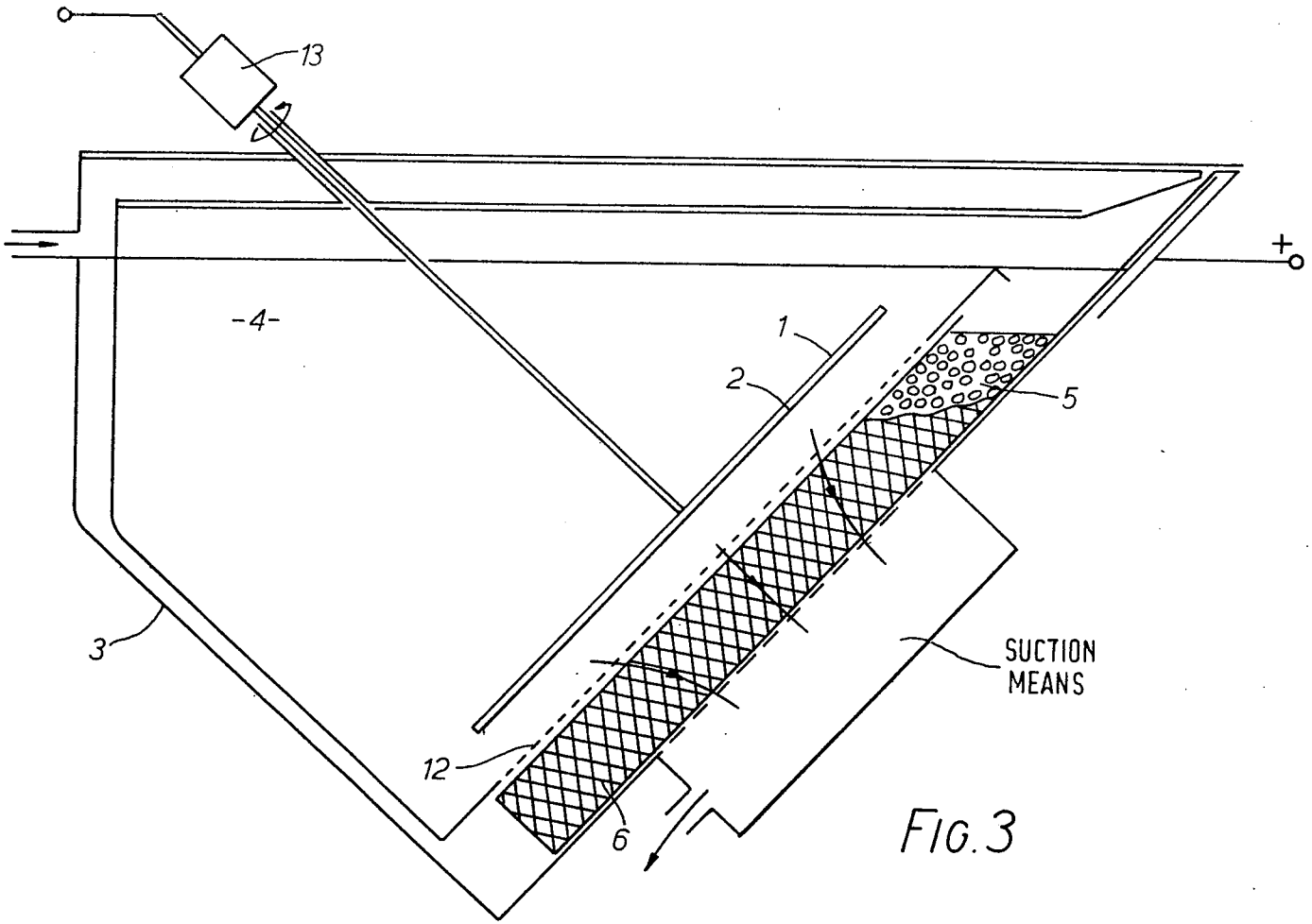

In order that the invention may be more readily understood specific embodiments will be described by way of example by reference to the accompanying drawings of which:

FIG. 1 illustrates a side view of one example of an electroplating arrangement of the present invention, FIG. 2 illustrates the means, used in the arrangement of FIG. 1 for inhibiting flow of the electrolyte from the region of the anode towards the cathode plating surface, and FIG. 3 shows a schematic side view of an alternative example of an electroplating arrangement of the present invention.

It will be appreciated that the present invention is not limited to the particular embodiment described; other embodiments will be readily envisaged by a person skilled in the art.

The arrangement illustrated in FIG. 1 of the drawings is suitable for the formation of stamper plates of the type used for moulding disc records. As is known in the art, a negative impression of a recording may be formed on the stamper plate which is then used to create a positive impression by moulding plastics material to form the disc record.

Referring to FIG. 1 a cathode, 1, has a disc shaped plating surface, 2, and is suspended in a tank, 3, containing an electrolyte, 4, opposite a source of an anode material, 5, contained within an anode basket, 6. The basket is typically made of titanium and has an open mesh construction which permits a flow of electrolyte through the anode material which is conveniently in the form of loose spheres or cubes.

For efficiency of plating it is necessary that in the region between the electrodes the electrolyte be continuously refreshed. This has been achieved in previous arrangements by forcing the electrolyte through the anode basket towards the cathode, or alternatively across the surface of the anode. At high current densities, typically above about 250A/ft$^2$, this procedure proves to be unsatisfactory since nodules tend to form at the cathode surface during plating. This is thought to be due to the physical transport through the electrolyte of suspended impurities, released from the anode at high current density, which are deposited on the cathode and form nuclei on which nodules may grow.

In the present invention the flow of electrolyte from the region of the anode to the cathode surface is inhibited so that impurity particles released at the anode, and which are thought to be responsible for the formation of nodules, are substantially prevented from reaching the plating area.

In the illustrated embodiment this object is achieved by causing a positive flow towards the anode using a substantially circular tube, 7, preferably of a plastics material e.g. polypropylene or PVC, which encloses the region between the electrodes. This tube is shown in perspective view in FIG. 2 of the drawings. Filtered electrolyte is supplied to the tube, 7, via a detachable feed pipe, 8, and is admitted to the interelectrode region, 9, through a plurality of inwardly facing holes, 10, disposed around the internal circumference of the tube. Typically the tube has a cross-sectional diameter of 2 cm, and forms a circular ring having an outside diameter of between 35 and 40 cm. The holes, 10, have a diameter of 3 mm and are spaced at 5 cm intervals.

Alternatively the holes may typically have a diameter of between 2 and 5 mm. With this arrangement a high pressure region is developed close to the cathode surface so that electrolyte enclosed by the tube must flow towards the anode, as indicated by the arrows at A. In this manner impurity particles formed at the anode, are prevented from reaching the plating area.

It is of course not essential that the tube, 7, encloses the whole of the region between the anode and cathode, it is only necessary for a region of relatively high pressure to be developed in the electrolyte close to the cathode.

In an alternative arrangement, therefore, the circular tube, 7, may be positioned adjacent to the cathode surface but spaced away from the anode.

As fresh electrolyte enters the tank, 3, via the tube, 7, excess electrolyte leaves the tank via an overflow pipe, 11, and is filtered and recycled. The filter means (which is capable of trapping particles greater than 0.3 μm) and the pumping means are not shown in the drawing but will be readily envisaged by a person skilled in the art. To further assist filtration a terylene screen, 12, is placed across the anode surface.

In an alternative arrangement the desired inhibition of flow electrolyte from the anode can be achieved by establishing a region of relatively low pressure below the anode basket, for example, by positioning a suction means at that point. A schematic side view of such an arrangement is shown in FIG. 3, the references having the same meaning as those in FIG. 1.

In the illustrated embodiment both the cathode and the anode basket are inclined to the horizontal, at an angle of about 45°, so that a uniform profile of the anode material, defined by the upper surface of the basket, may be maintained opposite the cathode plating surface. Other angles, between 30°and 60°, could alternatively be adopted. Although the inclined arrangement illustrated in the drawing is to be preferred, the present invention can also be applied to an arrangement in which the anode basket and the cathode surface assume horizontal positions.

To further improve the uniformity of the plated surface it is usual for a drive means, 13, to rotate the cathode about an axis perpendicular to the plane of the plating surface, typically at a speed of about 200 r.p.m. Electrical connections to the basket and drive means are made, as shown in FIG. 1, and these are arranged to provide a difference in electrical potential between the anode and cathode. As is known in the art contact with the drive means may be achieved by means of electrical contact brushes.

Typically the stamper plates are made of nickel (although copper is sometimes used) and in the present example the anode material comprises loose nickel spheres and the electrolyte is prepared from a solution of a major proportion of nickel sulphamate (typically 600 gm/1) and minor proportions of nickel chloride (typically 10–15 gm/1) and boric acid (typically 40 gm/1).

With the present arrangement it is possible to use current densities of up to 700 A/ft$^2$ and yet still produce stamper plates free from the formation of nodules, and in this way the production time for a stamper plate can be more than halved.

Although the present invention is clearly applicable to the formation of stamper plates for disc records, or video discs (for which the quality of the moulding surface is particularly important) it will be appreciated that the present invention may be used in other applications in which a high quality electroplated surface is desired.

What we claim is:

1. An electroplating arrangement including a container for an electrolyte, an anode, a cathode having a plating surface and means for generating a flow of electrolyte away from the surface of the cathode, said flow generating means comprising a tube which, at least adjacent to the plane of the cathode surface, encloses a region between the cathode and anode and has a plurality of inwardly facing holes, thereby inhibiting flow of electrolyte from the region of the anode towards the cathode.

2. An electroplating arrangement including a container for an electrolyte, an anode, a cathode having a plating surface and means for generating a flow of electrolyte away from the surface of the cathode, said flow generating means comprising a suction means positioned below the anode, thereby inhibiting flow of electrolyte from the region of the anode towards the cathode.

3. An electroplating arrangement according to claim 1 wherein the tube encloses substantially the whole of the region between the cathode and anode.

4. An electroplating arrangement according to claim 1 or 3 wherein the diameter of said holes lies between 2 mm and 5 mm.

5. A stamper plate formed using an electroplating arrangement according to any one of claims 7, 8 or 3.

* * * * *